US005622350A

United States Patent [19]

Vande Haar

[11] Patent Number: 5,622,350

[45] Date of Patent: Apr. 22, 1997

[54] APPLIANCE WITH LOAD SHARING LEGS

[75] Inventor: Evan R. Vande Haar, Newton, Iowa

[73] Assignee: Maytag Corporation, Newton, Iowa

[21] Appl. No.: 254,155

[22] Filed: Jun. 6, 1994

[51] Int. Cl.[6] ..... F16M 1/00

[52] U.S. Cl. ..... 248/677; 248/188.3

[58] Field of Search ..... 248/638, 676, 248/677, 678, 188.2, 188.3, 188.4, 637; 312/351.5, 351.7, 351.8; 68/23 R, 23.1, 23.2, 23.3

[56] References Cited

U.S. PATENT DOCUMENTS

| | | | |
|---|---|---|---|
| 2,268,204 | 12/1941 | Dunham | 68/23.3 |
| 2,275,846 | 3/1942 | Dunham | 68/23.3 |
| 2,540,750 | 2/1951 | Morrison | 248/2 |
| 2,695,147 | 11/1954 | Castricone | 248/2 |
| 2,948,401 | 8/1960 | Obermajer | 68/23.3 |
| 2,976,998 | 3/1961 | Smith | 68/23.3 |
| 3,222,021 | 12/1965 | Sisler | 248/188.3 |
| 3,304,032 | 2/1967 | Yates | 248/2 |
| 3,488,982 | 1/1970 | Douglas | 68/23.3 |
| 3,798,931 | 3/1974 | Czech et al. | 68/23.3 X |
| 3,954,241 | 5/1976 | Carlson | 248/188.3 |
| 3,991,962 | 11/1976 | Kovats | 248/188.5 |
| 4,102,556 | 7/1978 | Webb | 312/250 |
| 4,124,187 | 11/1978 | Webb | 248/188.3 |
| 4,192,564 | 3/1980 | Losert | 312/253 |
| 4,262,870 | 4/1981 | Kretchman et al. | 248/188.3 |
| 4,801,114 | 1/1989 | Price | 248/188.3 |
| 4,917,345 | 4/1990 | Czech | 248/678 |
| 4,949,923 | 8/1990 | Daily | 248/188.3 |
| 5,249,440 | 10/1993 | Hossfield et al. | 68/23.3 |
| 5,257,516 | 11/1993 | Hossfield | 68/23.3 |

*Primary Examiner*—Korie Chan

*Attorney, Agent, or Firm*—Zarley, McKee, Thomte, Voorhees, & Sease

[57] ABSTRACT

An appliance, such as a washing machine, is provided with a cabinet connected to the base in such a manner so as to maintain flexibility of the base thereby accommodating uneven floors. The cabinet is rigidly secured to the base at three points spaced approximately 120° apart. Additional slip-fit securement is provided between the cabinet and base so as to prevent vibration of the cabinet against the base.

23 Claims, 6 Drawing Sheets

APPLIANCE WITH LOAD SHARING LEGS

BACKGROUND OF THE INVENTION

A conventional household appliance, such as a washing machine, typically includes a base with a cabinet mounted on the base. The washing tub assembly, drive motor, transmission and other structure are mounted on the base within the cabinet. A control panel is also provided at the top of the cabinet. Legs are normally provided at each corner of the base, and may be threaded into the base to allow for adjustment of the legs.

During the manufacturing process of an appliance, such as a clothes washer, the base and the cabinet are each flexible in their construction. In conventional appliances, the cabinet is secured to the base in a rigid manner so as to produce a non-flexible integral structure. Typically, there are several rigid connection points on each side of the machine, and one or more rigid connection points on the back. In prior art appliances, the cabinet is secured to the base in a rigid manner through multiple rigid connection points on each side of the machine and one or more rigid connections on the back. This plurality of rigid connections between the cabinet and the base form a rigid integral structure in the prior art appliances, with both the base and the cabinet losing their independent flexibility. Such a nonflexible appliance presents problems when the appliance is set upon an uneven or unlevel floor, particularly when the appliance is set into an opening which prevents access to one or both of the rear legs, for example, next to a cabinet fixture in a home. When such a rigid appliance is set upon an uneven or unlevel floor, if the legs are independent from one another, it is possible that only three legs may engage the floor, since the rigid base and cabinet structure prevents the base from twisting about a horizontal axis. Thus, the weight of the appliance will not be distributed among the four legs, and the appliance may vibrate excessively during operation. Some prior art appliances have attempted to overcome this problem by interconnecting the rear legs with a slider bar or linkage such that the rear legs will automatically retract or extend so as to insure that both legs are loaded equally. However, such interconnection between the rear legs requires that the legs be slideably mounted to the base, rather than threadably mounted, such that the height of the appliance cannot be adjusted, for example to match a countertop height. The interconnecting leg structure also requires large tolerances such that there is significant play or slop in the rear legs. Also, the slider bar or linkage structure adds to the cost of the appliance.

Accordingly, a primary objective of the present invention is the provision of an improved appliance having load sharing legs.

Another objective of the present invention is the provision of an appliance, such as a washing machine, wherein the cabinet is attached to the base such that the base is torsionally flexible.

Another objective of the present invention is the provision of an improved appliance wherein the cabinet is rigidly attached to the base at a minimum of points so as to maintain flexibility of the base.

A further objective of the present invention is the provision of an appliance having legs which are independently adjustable such that the height of the appliance can be adjusted.

Still another objective of the present invention is the provision of a method of attaching an appliance cabinet to a base in such a manner that the appliance can be quickly and easily installed on an uneven or unlevel floor and adjusted to a desired height.

These and other objectives will become apparent from the following description of the invention.

SUMMARY OF THE INVENTION

The improved appliance in a preferred embodiment of the present invention includes a flexible base with a cabinet attached thereto. The cabinet is rigidly secured to the base at three points, one centered along the back edge of the base, and one adjacent the front corner of each side of the base. The connection points between the cabinet and base are approximately 120° apart and a leg is received within each corner of the base. When the appliance is set upon an uneven or unlevel floor, the three rigid connection points allow the base to flex such that the legs of the base will engage the floor and share the load of the appliance. Thus, the legs can be maintained independent of one another, without the need for an interconnecting slider bar or other linkage between the legs. The legs are adjustably received in the base and the height of the appliance can be adjusted, for example such that the top of the appliance is level or coplanar with an adjacent counter top.

DETAILED DESCRIPTION OF THE DRAWINGS

Figure 4:
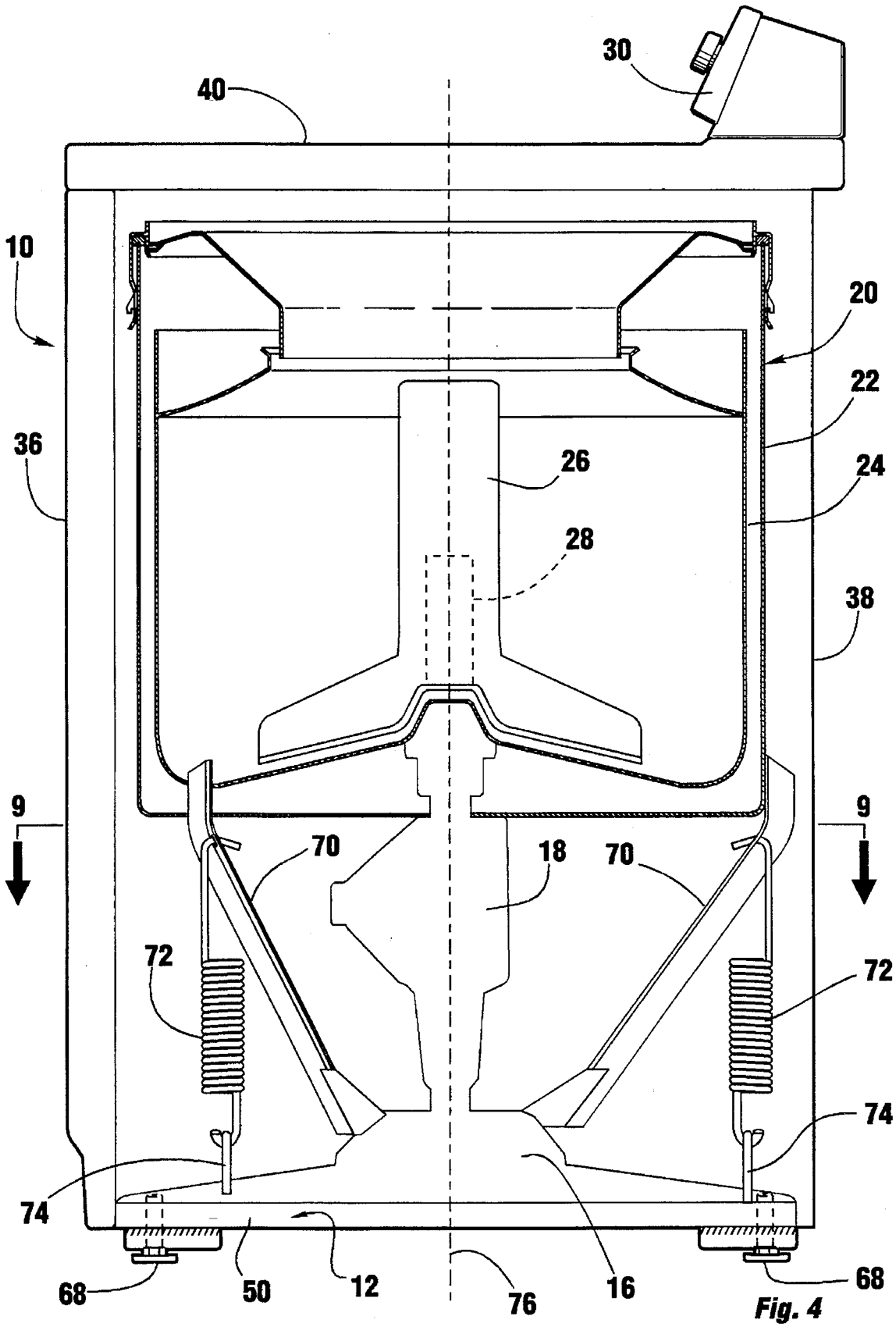
FIG. 4 is a side sectional view showing the primary internal components of the washing machine.

With reference to the drawings, a clothes washing machine is generally designated by the reference numeral 10. The washing machine 10 includes a flexible base 12 with a cabinet 14 attached to the base. The base 12 includes a damper 16. An electric motor (not shown) is mounted on the base 12 and is operatively connected to a transmission 18, which in turn operatively supports the washing machine tub assembly 20, as best seen in FIG. 4. The tub assembly 20 includes an outer tub 22, an inner wash basket 24, and an agitator 26 mounted upon a spindle 28 extending from the transmission 18. A control panel 30 having functional controls is provided on the top of the cabinet 14 for controlling the operation of the washing machine 10. The control panel 30, transmission 18, and tub assembly 20 are conventional, and do not constitute a part of the present invention.

The cabinet 14 includes a right side wall 32, a left side wall 34, a front wall 36 and a rear wall 38. The right wall 32, left wall 34 and rear wall 38 preferably have a one-piece construction, with the front wall 36 being a separate panel. A top 40 is provided on the cabinet 14 with a conventional lid (not shown) movable between an open and closed position to provide access to the wash basket 24.

The base 12 includes a right side edge 42, a left side edge 44, a front edge 46, and a rear edge 48. The edges 42–48 define four corners of the base. The base also includes a perimeter flange 50 extending around the edges 42–48.

The cabinet 14 is rigidly attached to the base 12 at three connection points. The first rigid connection point is located approximately in the center of the rear wall 38 of the cabinet 14, and includes a fastener 52, such as a screw or bolt, extending through aligned apertures in the cabinet 14 and flange 50 of the base 12. A second rigid connection point is provided in the right side wall 32 of the cabinet 14 adjacent the front right corner of the base 12, and includes a second fastener 54 extending through aligned holes in the right side wall 32 of the cabinet 14 and the flange 50 of the base 12. A third rigid connection point is provided on the left side wall 34 of the cabinet 14 adjacent the front left corner of the base 12, and includes a fastener 56 extending through aligned holes in the left side wall 34 of the cabinet 14 and the flange 50 of the base 12. The fasteners 52, 54, and 56 are screws, bolts, or the like and are spaced approximately 120° apart.

The rigid fasteners 52, 54 and 56 provide stability between the cabinet 14 and the base 12, while maintaining the torsional flexibility of the base 12 so that the base 12 can flex to match the floor 78. The torsional flexibility of the base 12 is thus effective in adjusting to an uneven or unlevel floor 78, as described below.

Figure 1:
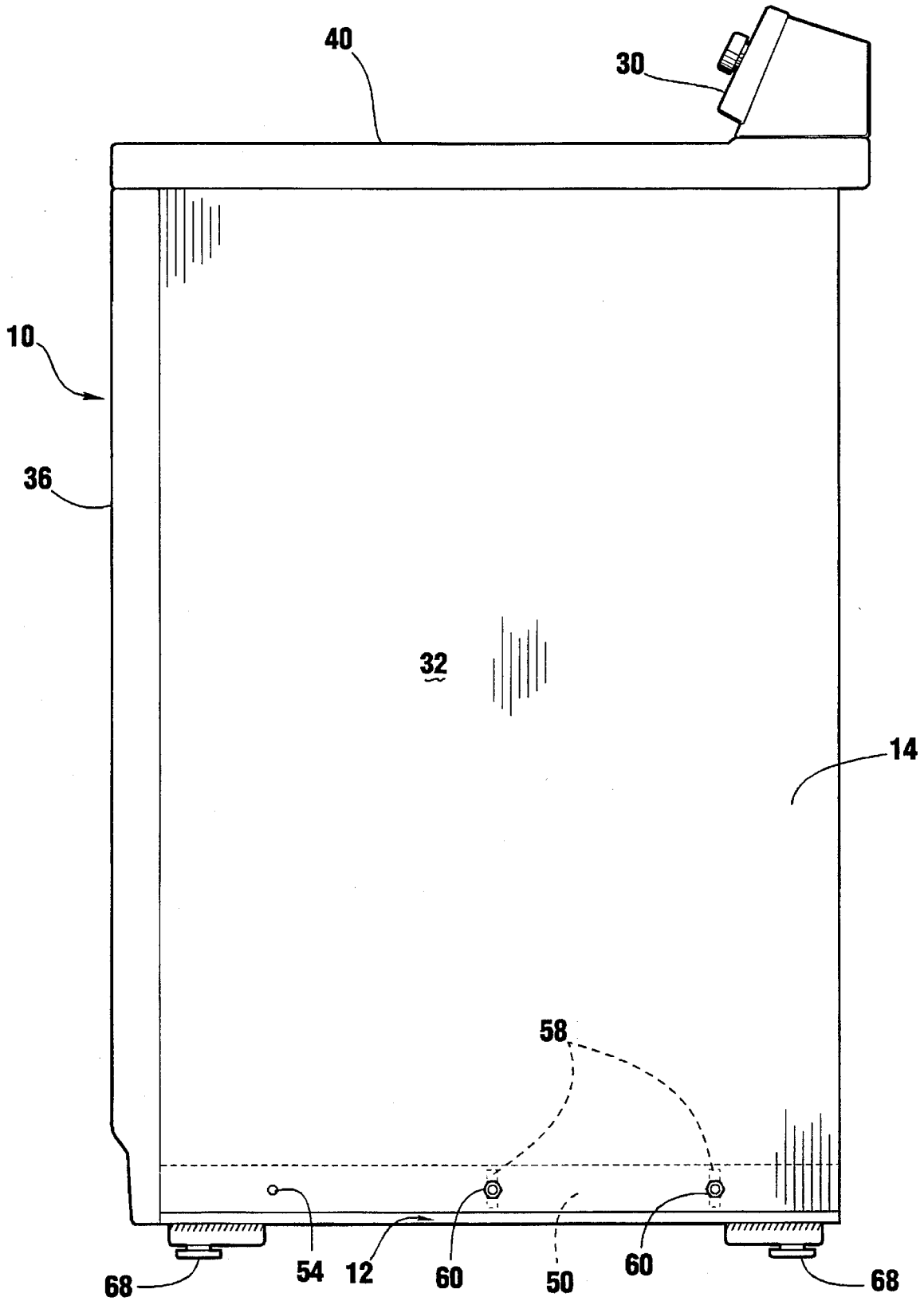
FIG. 1 is a left side elevational view of a clothes washing machine according to the present invention.
Figure 2:
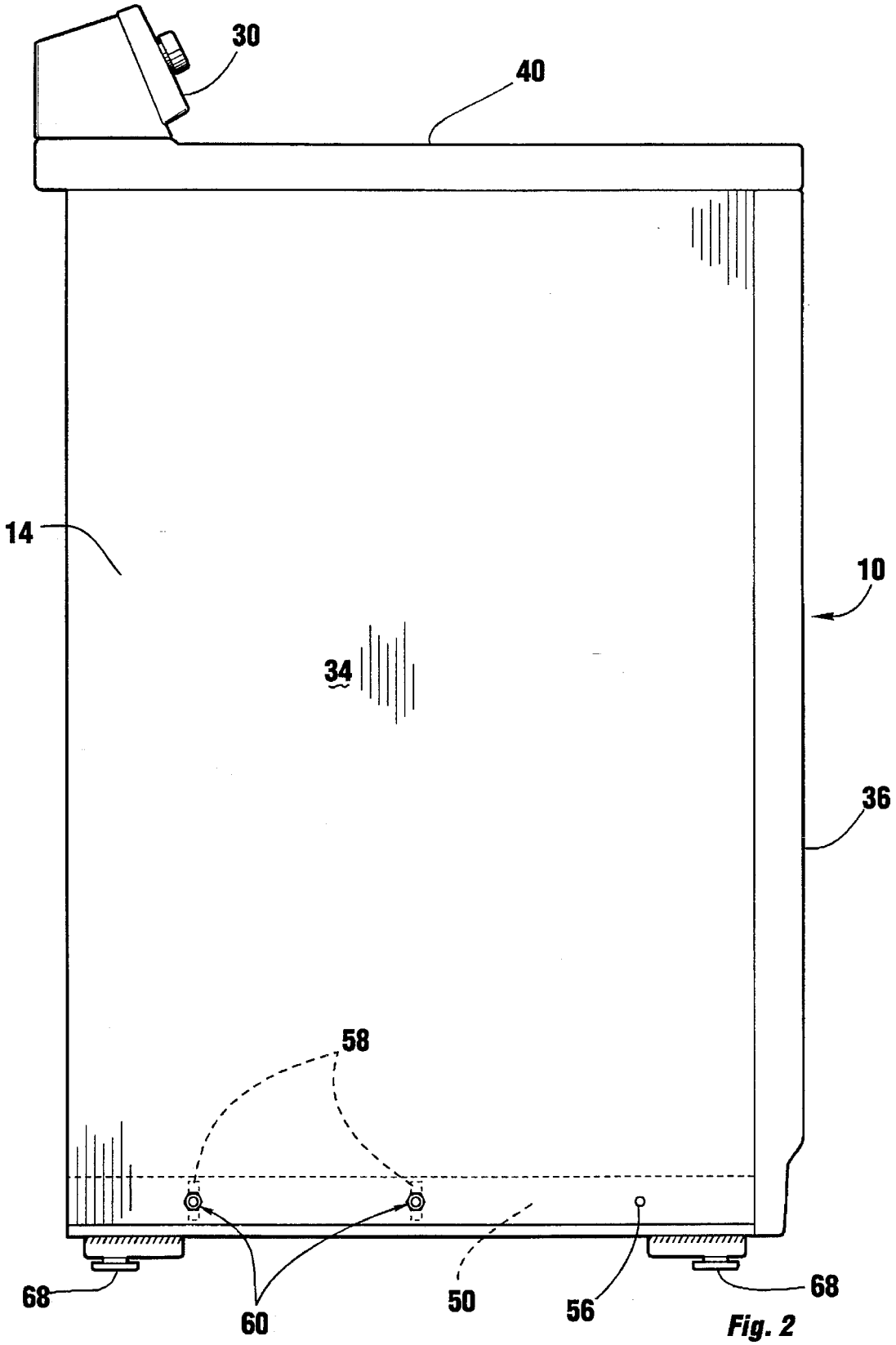
FIG. 2 is a left side elevational view of the washing machine.
Figure 3:
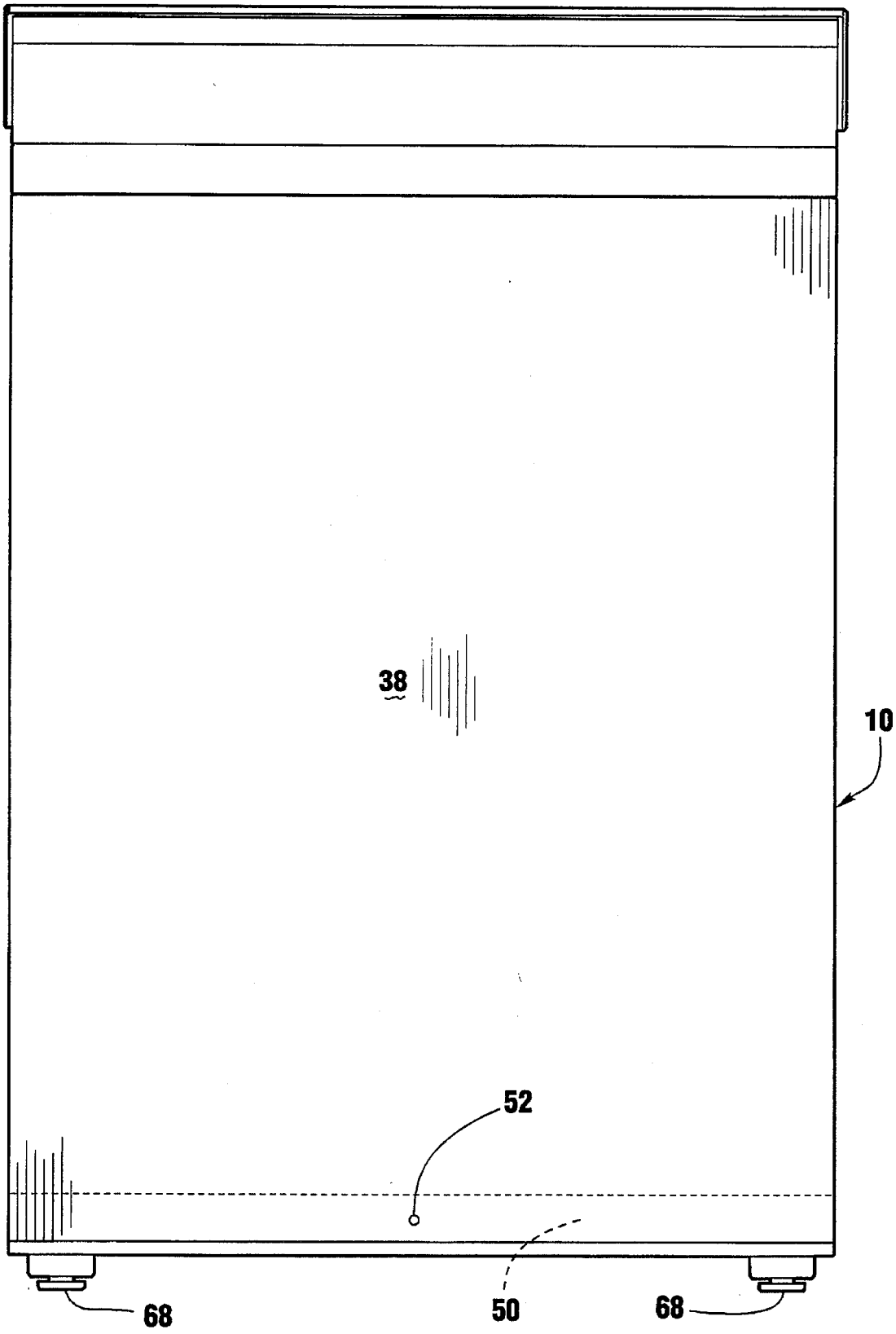
FIG. 3 is a rear elevation view of the washing machine.
Figure 7:
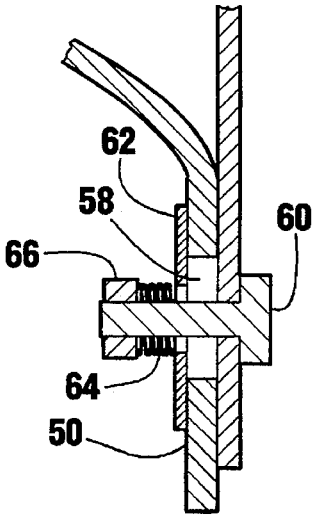
FIG. 7 is an enlarged sectional view showing the slidable securement means for prevent rattling of the cabinet of the washing machine.

Additional securement means are provided for slidably interconnecting portions of the cabinet 14 with the base 12 so as to prevent vibration or rattling of the cabinet 14 relative to the base 12. More particularly, at least on the opposite sides of the base, the flange 50 is provided with generally vertically oriented slots 58, as seen in FIGS. 1, 2 and 7. Holes in the side walls 32, 34 of the cabinet are aligned with the slots 58 so that bolts 60 can extend therethrough. A washer 62 engages the inside surface of the flange 50, as best shown in FIG. 7. A spring 64 is provided on the bolt 60, which receives a nut 66 on its inner end. The spring loaded nut and bolt assembly extending through the hole in the side wall of the cabinet 14 and the slot 58 in the flange 50 of the base 12 allows the adjacent portion of the cabinet side wall to slide slightly with respect to the base 12, thereby maintaining the torsional flexibility of the base 12.

Each corner of the base 12 includes a leg 68, which is threadably received in the base 12 in the conventional manner. Thus, the legs 68 can be extended or retracted with respect to the base 12. Each of the legs 68 is independent from the other legs.

Figure 6:
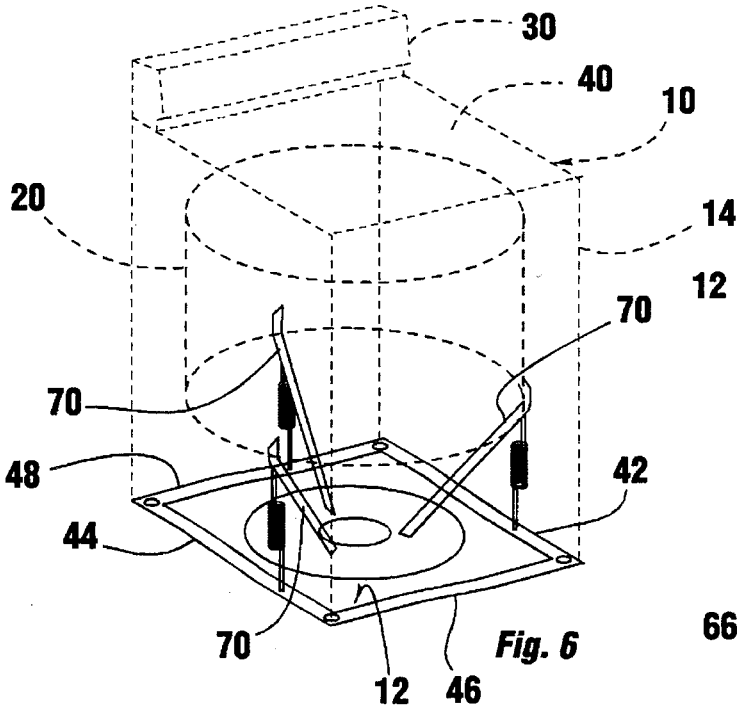
FIG. 6 is a perspective schematic illustrating the arrangement of the primary internal components of the washing machine.
Figure 9:
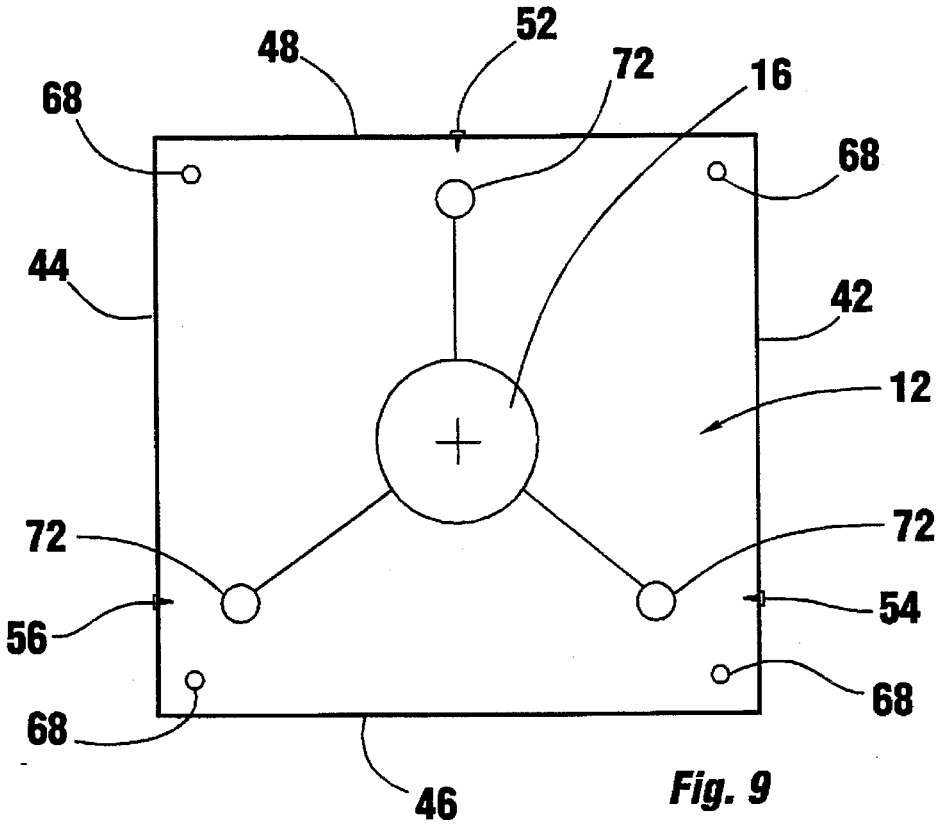
FIG. 9 is a schematic view taken generally along lines 9—9 of FIG. 4 showing the relative position of the leg braces and springs of the washing machine.

The tub assembly 20 is supported within the cabinet 14 and above the base 12 by three support braces 70, as best seen in FIGS. 4 and 6. As seen in FIG. 9, the support braces 70 are spaced approximately 120° apart. A spring 72 extends from the upper end of each support brace 70 downwardly to the base 12 adjacent or in substantial alignment with the fasteners 52, 54 and 56, as best seen in FIG. 6 and 9. As seen in FIG. 4, the lower end of springs 72 are attached to the base 12 by a clip, ring or other catch member 74. The springs 72 maintain the tub assembly 20 in a centered orientation along the central axis 76 of the washing machine 10.

The orientation of the support braces 70 and springs 72 is 60° from the conventional orientation of the braces and springs in most prior art washing machines. In other words, in conventional washing machines, one support brace and associated spring would extend forwardly towards the center of the front wall of the cabinet, while the remaining two support braces and springs extended rearwardly towards the rear corners of the base. In the present invention, it has been discovered that the conventional orientation of the support braces and springs does not maintain the tub assembly 20 in a centered position along the central axis 76. However, when the support braces 70 and springs 72 are oriented as shown in FIG. 9 so as to be adjacent the rigid connection points provided by fasteners 52, 54 and 56, the tub assembly 20 remains centered along the central axis 76.

Figure 5:
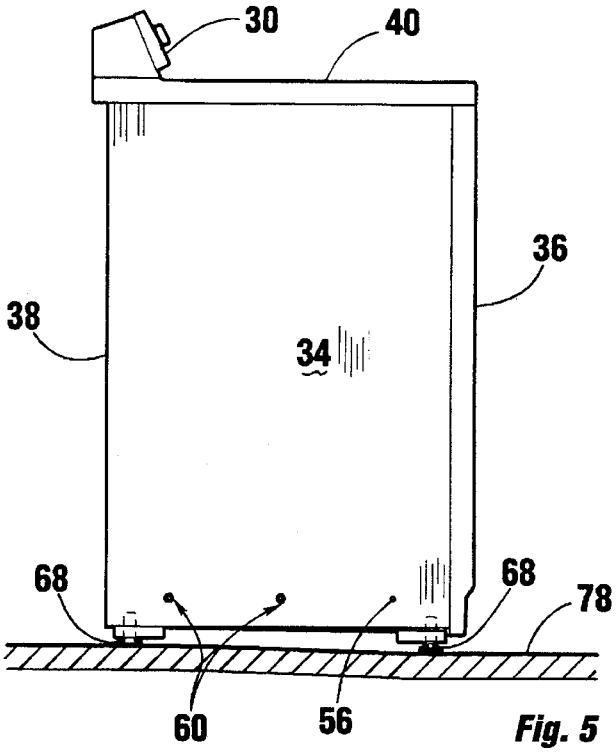
FIG. 5 is a left side elevation view showing the washing machine installed on an uneven floor.
Figure 8:
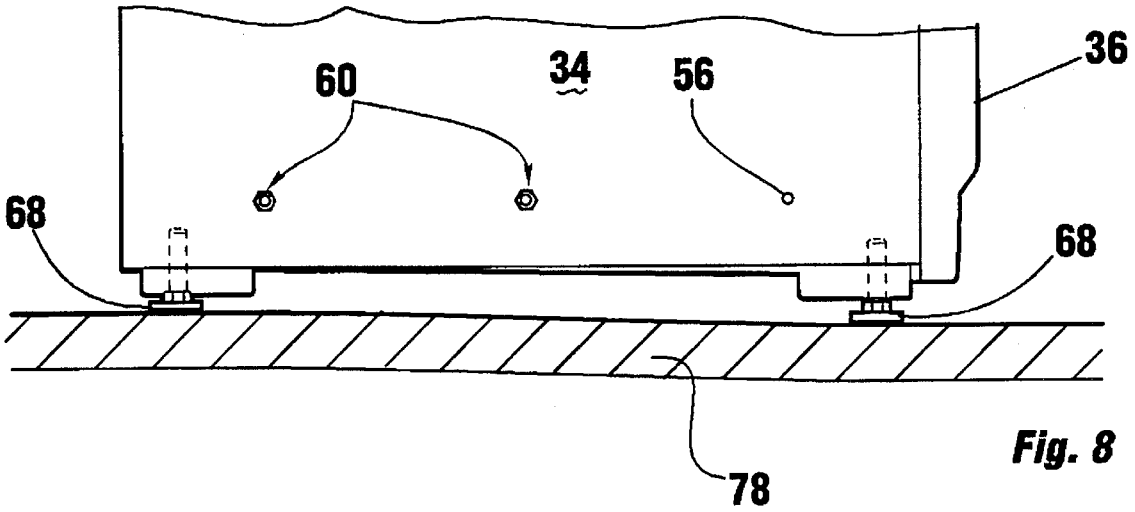
FIG. 8 is an enlarged partial elevational view similar to FIG. 5 showing the torsional flexing of the base when the washing machine is positioned on an uneven floor.

The washing machine 10 of the present invention is especially adapted for quick and easy installation on uneven or unlevel floors. FIGS. 5 and 8 show the machine 10 on such an unlevel or uneven floor 78. When installing the machine in place in a home or household, the back legs 68 in the rear corners of the base 12 are threadably adjusted to a desired height, such that the top 40 of the cabinet 14 is at a desired height. For example, if the washing machine 10 is set adjacent a counter, it is normally desirable that the top of the machine be level or coplanar with the top of the counter. The rear legs do not necessarily have to be extended the same distance from the base. For example, if there is a counter on each side of the washing machine 10, but the floor between the counters is uneven such that the distance from the floor to each counter top is different, the independent adjustability of the legs will accommodate the uneven floor. The three point rigid connection between the cabinet 14 and the base 12, as provided by fasteners 52, 54 and 56, allows the base 12 to torsionally flex to accommodate the uneven floor 78. The slidable securement provided by the nut and bolt assemblies comprised of members 60–66 also allow the base 12 to flex relative to the cabinet 14, while preventing vibrations therebetween.

After the washing machine 10 is set in place, the front legs 68 adjacent the front corners of the base 12 can be adjusted independently so as to level the top 40 of the machine 10. In prior art appliances having a non-flexible integral cabinet and base structure, such leveling of the top of the machine upon an uneven floor would also require adjustment of at least one rear leg.

Accordingly, the present invention overcomes the problems in the prior art. More particularly, the present invention connects the cabinet 14 to the base 12 in such a manner as to maintain the flexibility of at least the rear portion of the base 12. Such flexibility of the assembled appliance or washing machine 10 is achieved by utilizing no more than one rigid connection between the base 12 and appliance 14 on any side or edge of the appliance. Thus as seen in the drawings, a single fastener 52 is provided on the rear edge 48 of the base 12 and cabinet 14 to provide a rigid connection therebetween, and similarly, single fasteners 54 and 56 are provided on right and left side edges 42 and 44 of the base 12 and cabinet 14 to provide a single point of rigid connection therebetween. The bolts 60 provided on each side of the appliance do not provide a rigid connection, but rather provide a slidable connection via slots 58 in the base. Thus, the flexibility of the base 12, with the cabinet 14 mounted thereon, is maintained. The bolts 60 do not affect the flexibility of the base.

The base 12, which is connected to the cabinet 14 by the fasteners 52, 54 and 56 flexes relative to the cabinet, since there is no more than one rigid connection point on any side or edge. The bolts 60 provide relative movement between the cabinet 14 and the base 12 due to the slot 58 in the base. While there is no relative movement between the base 12 and the cabinet 14 adjacent the fasteners 52, 54 and 56, a corner of the assembled appliance is flexible relative to other corners due to the minimum utilization of rigid connection points, that is, no more than one rigid connection on any side or edge of the appliance.

In the present invention, the front legs of the appliance are normally accessible. Thus, if one or both of the front legs sit upon an uneven floor, the legs can be threaded upwardly or downwardly in the base to accommodate the floor.

In comparison, the rear legs are oftentimes inaccessible due to the location of the appliance next to cabinets or other obstructing structures. Thus, if the floor is uneven such that the leg on one rear corner is at a different level than the other three legs, the base will torsionally flex. For example, if the floor is uneven such that the floor subjacent the left rear leg is at a lower level than the other three legs, the rear of the base flexes torsionally downwardly from the right rear leg and left front leg to the left rear leg, such that the left rear leg engages the floor. The rear edge 48 of the base 12 will remain substantially parallel to the side-to-side plane of the floor at the rear of the appliance, and the left edge of the base 12 will remain substantially parallel to the front-to-back plane of the floor at the left side of the appliance. This flexing can take place relative to the cabinet 14 because of the spring loaded nut and bolt assemblies 60, 62, 64 and 66 in conjunction with the slots 58 in the base.

Thus, the washing machine of the present invention provides a simpler and less expensive construction as compared to those appliances with rear legs interconnected by a linkage mechanism, while allowing for height adjustability of the top of the machine. It is also understood that the unique flexible interconnection between the cabinet and the base, as described above, can be utilized on other appliances which may be set upon an uneven floor or support surface.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. An appliance comprising:

a flexible base;

independent legs extending downwardly from the base;

a cabinet connected to the base at three connection points for providing substantial stability of the cabinet upon the base while maintaining flexibility of the base, whereby the weight of the appliance will cause the base to flex with respect to an uneven floor such that each leg will engage the floor and thereby share the load of the appliance.

2. The appliance of claim 1 wherein the three connection points are spaced approximately 120° apart.

3. The appliance of claim 2 wherein the base has opposite side edges, a rear edge, and a front edge, with a first connection point on the back edge, a second connection point on one side edge, and a third connection point on the opposite side edge.

4. The appliance of claim 1 further comprising mounting means for rigidly connecting the cabinet to the base.

5. The appliance of claim 4 wherein the base has a perimeter flange with opposite sides, a front and a back, and the mounting means includes a first fastener extending through the cabinet and through the rear of the perimeter flange, a second fastener extending through the cabinet and through one side of the perimeter flange, and a third fastener extending through the cabinet and through the other side of the perimeter flange.

6. The appliance of claim 1 wherein the base has a perimeter flange, with a plurality of vertically oriented slots, and further comprising securement means slidably extending through the slots and through the cabinet to allow relative movement between the base and cabinet and to prevent vibration of the cabinet.

7. The appliance of claim 6 wherein each securement means includes a spring loaded nut and bolt assembly.

8. The appliance of claim 1 and further including a wash tub assembly operatively mounted within the cabinet, with three leg braces supporting the wash tub assembly above the base and a spring extending between each leg brace and the base, adjacent each connection point.

9. A method of attaching an appliance cabinet to a flexible appliance base, the base having a front edge, a rear edge, and opposite side edges defining four corners, a perimeter flange, and a leg adjacent each corner, the method comprising:

inserting first, second and third fasteners through the cabinet and the perimeter flange of the base adjacent three of the edges thereof so as to connect the cabinet to the base while maintaining the flexibility of the base;

whereby the weight of the appliance will cause the base to flex relative to the cabinet so that all the legs will engage the floor to evenly distribute the weight thereon.

10. The method of claim 9 further comprising inserting a plurality of securement means through the cabinet and the perimeter edge of the base so as to permit slidable movement between the cabinet and base adjacent each securement means and so as to prevent vibration of the cabinet against the base.

11. A washing machine comprising:

a flexible base having a front edge, a rear edge, and opposite side edges defining four corners of the base, and having a flange extending substantially vertically from each of the edges;

a leg extending downwardly from the base adjacent each corner thereof;

a cabinet mounted upon the base and having a front wall, a back wall, opposite side walls, and a top wall;

first, second, and third fasteners extending through three of the walls of the cabinet and through the flange of the base along three corresponding edges thereof so as to connect the cabinet to the base while maintaining the flexibility of the base, whereby the weight of the appliance will cause the base to flex and conform to an uneven floor such that each of the legs engage the floor to evenly distribute the weight thereon.

12. The washing machine of claim 11 wherein the fasteners are spaced approximately 120° apart.

13. The washing machine of claim 12 wherein the fasteners are located in the side walls and rear wall of the cabinet.

14. The washing machine of claim 12 wherein the first fastener is located in the rear wall of the cabinet substantially equidistant between the side walls.

15. The washing machine of claim 11 further comprising a plurality of securement means extending through the cabinet and the flange of the base to permit slidable movement therebetween and so as to prevent rattling of the cabinet upon the base.

16. The washing machine of claim 15 wherein the perimeter flange has vertically oriented slots through which the securement means slidably extend.

17. The washing machine of claim 15 wherein the securement means are each a nut and bolt assembly.

18. The washing machine of claim 17 wherein each nut and bolt assembly includes a spring to provide sliding frictional engagement between the cabinet and the flange of the base.

19. The washing machine of claim 11 further comprising a wash tub mounted within the cabinet, three leg braces supporting the tub above the base and a spring extending between each leg brace and the base adjacent each fastener.

20. The appliance of claim 1 wherein the cabinet is rigidly connected to the base at only the three connection points.

21. The method of claim 9 further comprising rigidly securing the cabinet to the base at no more than one point along each side edge and rear edge.

22. The washing machine of claim 11 wherein the first, second, and third fasteners rigidly connect the cabinet to the base while maintaining flexibility of the base.

23. The washing machine of claim 11 wherein the cabinet and base have no more than one rigid connection therebetween on any edge.

* * * * *